US005899445A

United States Patent [19]

Kimble

[11] Patent Number: 5,899,445

[45] Date of Patent: May 4, 1999

[54] LOCKING RING VACUUM CLAMPING SYSTEM WITH LOAD/UNLOAD CAPABILITIES

[76] Inventor: Alvin J. Kimble, 13035 SE. Claybourne, Portland, Oreg. 97236

[21] Appl. No.: 08/945,009

[22] PCT Filed: Apr. 18, 1996

[86] PCT No.: PCT/US96/05488

§ 371 Date: Oct. 14, 1997

§ 102(e) Date: Oct. 14, 1997

[87] PCT Pub. No.: WO96/33049

PCT Pub. Date: Oct. 24, 1996

[51] Int. Cl.[6] ..... B25B 11/00

[52] U.S. Cl. ..... 269/21; 269/296; 269/293

[58] Field of Search ..... 269/21, 289 R, 269/296, 293

[56] References Cited

U.S. PATENT DOCUMENTS

| | | | |
|---|---|---|---|
| 4,723,766 | 2/1988 | Beeding | 269/21 |
| 4,805,887 | 2/1989 | Ray | 269/21 |
| 5,553,837 | 9/1996 | Kahle | 269/21 |

*Primary Examiner*—Timothy V. Eley
*Assistant Examiner*—Sinclair Skinner
*Attorney, Agent, or Firm*—Marger Johnson & McCollom, P.C.

[57] ABSTRACT

An apparatus for supporting and vacuum chucking a work piece have a mounting surface, a surface having a spaced array of apertures defined therein which are operatively connected to a vacuum source. The apparatus also contains a plurality of fixed pods each seated over and surrounding one of a apertures, said pods having an upper surface for supporting a work piece above the mounting surface and further having a hollow interior adapted to receive an accessory therein to transmit the vacuum to the work piece and locking components for fixing the pods to mounting surface.

21 Claims, 11 Drawing Sheets

LOCKING RING VACUUM CLAMPING SYSTEM WITH LOAD/UNLOAD CAPABILITIES

BACKGROUND OF THE INVENTION

The present invention generally relates to the machining arts and more particularly to a safety and control system for manipulating a workpiece above the surface of a vacuum bed worktable for machining while protecting the vacuum bed from damage during the machining process.

There are three vacuum clamping concepts presently known to the field, all of which rely on a vacuum source and an enclosure (vacuum bed) upon which the clamping device is located. The "vacuum bed", which may or may not be an integral part of the computer numerically controlled (CNC) machining center, creates a negative pressure environment and transfers it, via a series of holes, to its surface. In the following documentation, the term "vacuum bed" is understood to be the above described method of achieving vacuum.

The most common method of achieving vacuum clamping is to use a spoilboard. The spoilboard is secured to the vacuum bed and a series of holes are drilled (within the boundaries of a foam gasket) through it to allow vacuum pressure to be transferred to its surface from the vacuum chamber. Once the workpiece is securely held by vacuum pressure to the spoilboard, the CNC machining center can perform a varied number of operations such as routing, cutting or drilling. As the spoilboard is made of relatively inexpensive materials, any damage to the spoilboard would be negligible compared to the cost of repairing or replacing the vacuum bed itself.

The second method of achieving vacuum clamping is to use flip pods. Presently, there are two known variations of this application: the Effner flip pod system disclosed in U.S. Pat. No. 5,222,719 and the Carter flip pod system marketed by the Carter Company.

Each flip pod system includes a spoilboard having an array of cavities machined therethrough. Depending upon the size and shape of the workpiece which is to be machined and the machining process desired, a pod is selectively placed into each cavity in either its "deactivated" position (flush with its host spoilboard) or its "activated" position (elevated and sitting upon its host spoilboard). The pod is designed to sit flush with the surface of its host spoilboard cavity, and to create a seal, thus preventing the transfer of negative atmospheric pressure to the general atmosphere, when it is in its deactivated position. Prior to machining, the machine operator manually turns the pod over in a predetermined configuration to create an elevated clamping surface. Once the workpiece is placed on the activated pods, the vacuum pump is turned on, thereby creating a vacuum clamping action between the pod and the workpiece laid on it. Machining is then commenced in such a manner as to direct the tool path of the machining center through its milling process without coming in contact with the pods themselves.

The Effner and Carter flip pod systems have several disadvantages. This process is necessarily time-intensive since each pod must be manually activated or deactivated for machining. Also, these pods require a workpiece that is nearly straight in order to achieve vacuum. If a workpiece is warped, some pods will not make contact with the under surface of the workpiece. This has the undesired effect of either reducing the clamping force because of vacuum leakage or does not draw sufficient vacuum pressure to hold the part at all. Another disadvantage of the flip pod systems is their inability to accommodate many irregular shapes or small work pieces, and because of this they exclude a substantial market share of CNC manufacturing.

The third method of achieving vacuum clamping is the "pop-up" system. An example of such a system is disclosed in U.S. Pat. No. 4,723,766 to Beeding. However, currently known "pop-up" systems such as Beeding are complex and prohibitively expensive compared to other systems.

The pop-up pod systems have the same general components and activation concepts and mechanisms. They are all placed within the vacuum bed or a vacuum container and are "activated" or "deactivated" in principally the same manner. Therefore, the following description should adequately cover all patents in this category.

The Beeding pop-up pod system is composed of a vacuum bed having an array of cavities into which a quantity of pods are placed. Each of the pods are either in one of two states. The pods can be in an "active" state in which they are raised to an elevated position above the surface of the vacuum bed. Alternatively, the pods can be in an "inactive" state in which they are lowered flush with the surface of the vacuum bed. The state of each pod is regulated by commands given through a CNC controller linked to the system.

The intent of the pop-up pod is to create an elevated working surface that transfers negative vacuum pressure from the vacuum bed to the surface of the pod. The workpiece is secured to the elevated pods by vacuum pressure during the machining process allowing the machining tool to penetrate it without damaging the surface of the vacuum bed.

To elevate a selected pod, positive air pressure is directed through a spool valve to an internal pneumatic cylinder which holds the pod against a fixed stop. Once the desired pods are elevated to their active position and the workpiece is placed on them, the machining program commences by turning on the vacuum pump (securing the material blank) and performing the desired machining operation. At the end of a machining operation or a multiple of the same operation (generally termed a "run"), all pods are retracted to their inactive position.

Though an advance in the automated machining art, vacuum bed systems constructed according to the Beeding reference include some inherent disadvantages. First, the pop-up systems constructed according to Beeding are too complex and expensive compared to conventional systems to make much of a commercial impact. With the Beeding system, the workpiece is raised only slightly above the working surface which is a highly machined surface with intricate vacuum clamping assemblies set into cavities. If a tool is misprogrammed in the vertical Z-axis, either or both the tool (along with its housing or bearings) and the workpiece is damaged or destroyed. Additionally, the Beeding pop-up system is not flexible enough to perform a variety of machine table functions such as load/unloading, clamping and the like which facilitates the machining process. Finally, Beeding by design is not capable of accommodating irregular shapes common to CNC manufacturing. For example, the Beeding pods are positionable in either a fully raised position or a fully lowered position. If the workpiece has an irregular surface, the vacuum clamping of the pods on the surface of the workpiece would be seriously impaired due to vacuum leakage.

Accordingly, the need arises for a vacuum bed system which provides a flexible, modular design in an automated bed which overcomes the complexity and expense of the prior art.

SUMMARY OF THE INVENTION

It is an object of the invention to provide a modular vacuum bed system which can be expanded at the option of the user as finances permit.

It is a further object of the invention to minimize damage to the expensive machining bed.

The invention is a vacuum clamping system which comprises an apparatus for supporting and vacuum chucking a workpiece. The system includes a mounting board surface having a spaced array of addressable apertures defined therein which are operatively connected to a vacuum source. The system further includes a plurality of fixed annular pods each seated over and surrounding one of said apertures, said pods having an upper surface for supporting a workpiece above the mounting surface and further having a hollow interior adapted to receive an accessory therein to transmit the vacuum to the workpiece. Each pod housing is selectively locked onto the mounting board to one of a plurality of addresses which designate the location of the pod housing. The combination of the fixed pod housing and the received accessory are referred to herein as the "locking ring vacuum clamping system".

The locking ring vacuum clamping system is suitable for any numerically controlled (NC) device that needs parts held during the manufacturing process. It meets various manufacturing needs by being modular, user friendly, evolutionary and fully automated. Because it is modular, a starter system may comprise of only a mounting board and slip-sheets which can be constructed of inexpensive segmented foam as described in more detail below. With further modular additions herein described, the system can grow to a fully automated system with auto load/unload (L/UL) capabilities. Its user friendly environment allows for programming the vacuum clamping routines or subprograms at the same time the part machining program is being developed.

In one embodiment, the system includes an off-set array of evenly spaced hexagon shaped vacuum clamping lock-ring assemblies. These assemblies hold the workpiece in a raised position during any number of milling processes.

The first and principal component to be discussed is the mounting board. The mounting board is a molded foam platform that is the foundation for the preferred variation of the vacuum clamping systems being designed, as well as for the load/unload (L/UL) assemblies. The mounting board includes a gridwork of holes and pockets, and contains all the wiring and air passages needed by the lock-ring assemblies or accessories premolded into the board. Normally, the mounting board is set directly on a vacuum bed. If this is not possible, a vacuum chamber or sub-platform can be supplied.

The locking ring assembly is a modular vacuum clamping unit that is independently activated and which mounts to the mounting board. An average system will have several hundred such assemblies which form a smooth honeycomb-appearing surface. It is comprised primarily of a cylindrical body (though body shape may vary to meet specific manufacturing needs), a vertically adjustable vacuum clamping ring that holds a workpiece via negative vacuum pressure elevated above the vacuum bed and an open center area that holds the lock-pin assembly, as well as provision for placement and removal of numerous accessories. Because of inexpensive materials and ease of assembly, maintenance is quickly accomplished by removing a damaged assembly and replacing it with a new one. This important feature saves a great deal of expense when a tool crashes into the table surface.

The locking ring system uses low voltage solenoids valving placed in the mounting board. Because the solenoids simply plug into the base, there is no wiring or plumbing for the end user to hassle with. Because it is electrical, it can be controlled by NC logic. Because it is inexpensive, the system is affordable.

The working principle of the solenoids is that they simply block air passage from the mounting board to the lock-ring assemblies (or accessories). The raising or lowering of a floating ring assembly as well as vacuum or air pressure to the center cavity area is controlled by the solenoids. It is the heart both of the vacuum bed as well as the L/UL unit. It is the only electrical/mechanical component in the system and is easily market available.

To best facilitate machining and handling of the workpiece, there are several accessories that have been developed as part of the overall system. All accessories are designed to replace the lock-pin assembly in the center cavity area of the pod housing.

One accessory is the floating ring. Often, materials to be machined are not perfectly smooth and uniform. The lock-ring system is designed to solve these machining problems by providing a floating ring in the pod housing. Soft springs allow it to conform to the irregular surface of the material presented for machining. When the vacuum pump is turned on, the floating ring is pulled securely to the top of the workpiece thus ensuring an exact machining height that does not vary due to the amount of vacuum pressure or compression of a cup or foam seal.

Another accessory facilitates the loading and unloading of the workpiece from the machining table. This accessory includes load/unload (L/UL) pins which fit into the center cavity of the locking ring assembly and are designed to rise above the surface of the floating ring when the center cavity is pressurized. They are made of UHMW or similar materials with a slightly arcuately curved surface that allows the workpiece to slide easily into the desired machining position.

Another embodiment includes L/UL transfer bearings which are designed to allow product to be rolled on or off the vacuum bed without scratching the surface. Their unique design not only allows for easy glide of the workpiece across the bearing surface, but is also self cleaning of debris that naturally reduces the functionality of a normal bearing conveyor system. They are designed to transfer product in any direction.

Still another embodiment includes powered L/UL feed rolls which use air power to feed material on and off the working surface. Preferably, the drive shaft is fixed while allowing the vaned housing to rotate in a predetermined direction about the axle. The pneumatic units simply use positive pressure as their energy source and, by the controlled exhausting of the spent air, are self cleaning. The rolls can be rotated in any direction so as to change the direction of rotation due to the disposition of the vane relative to the positive air pressure which drives the powered L/UL feed rolls. Load bearing capacity and handling speed are controlled by the machine NC controller.

Available also are intermediate L/UL accessories separate from the lock-ring assembly that make loading and unloading either automatic or semi-automatic. These accessories can sense the height of support scissor lifts or activate power feed conveyor systems.

Another accessory which can be received within the center cavity of the locking ring body is the fixed stop. Fixed stops include a vertical member which extends above the upper surface of the locking ring body and are used primarily in applications where the edges of the workpiece which abuts the fixed stop are not machined. As with the L/UL feed units, the fixed stops can be easily positioned anywhere on the vacuum bed.

Another type of stop is the pop-up stop which is also received within the center cavity of the locking ring body. Pop-up stops can be either in a raised active position or a lowered inactive position to facilitate the loading and positioning of several parts on the vacuum bed. They, like the L/UL feed units, can be easily positioned anywhere on the vacuum bed. In one embodiment, the pop-up stop accessory includes an vertical body positioned within the pod housing cavity and biased downward by a spring. Air pressure against the underside of the vertical body biases the stop body upward against the spring to lift the stop body to a raised position. The pop-up stop can be set slightly higher than the L/UL accessories and can be drawn flush with the upper surface of the pod housing or alternately drawn downward below the level of the L/UL accessories when vacuum pressure is present. Through control logic, they can also be dropped for unloading the vacuum bed after a run is completed. The combination and programmability of the pop-up stops and L/UL feed units makes the lock-ring system the most versatile system available.

Still another possible accessory is the cap. The cap is a special assembly that fits into or over the center cavity of the pod housing for the purpose of holding irregular or small workpieces during the machining process. It is built in sections segmented in the same pattern as the ports of the vacuum bed mounting board. The cap can be separated into a single section or groups of sections as the workpiece dictates. Its specific purpose is to create a smooth sealed surface onto which a special gasket strip can be placed in any configuration needed to accommodate specific vacuum clamping requirements not attainable by the normal bed configuration.

Yet another possible accessory is the vertical stack clamp which is used in situation in which layers of sheets are to be machined at the same time. The vertical stack clamp is a vertically adjustable pneumatic clamp that is mounted onto a stem rising from its base. Its purpose is to provide a positioning stop (ie: the stem) and pneumatic clamping of workpieces which are stacked or which cannot otherwise all be held by vacuum during the machining process. When in their deactivated condition, the stem is raised to its maximum height. The clamp bar is set slightly higher than the thickness of the material to be held. Once the workpiece is positioned against the stem, the controlling solenoid is energized and the stem is pulled down, clamping the workpiece.

The manual or override control bar is a long switch assembly attached to the front of the mounting board. Its purpose is to allow the operator to individually manually operate any lock-ring assembly or accessory mounted on the mounting board.

The auto load/unload system is a simplified, although inverted version, of the mounting board. The system includes an array of vacuum pods which are maneuverable over a workpiece. Once the pods vacuum chuck the top surface of the workpiece, the workpiece is lifted by a pneumatic arm and placed on the machining bed. The vacuum is then removed and the workpiece undergoes the predetermined machining process. Once completed, the workpiece is lifted and unloaded from the worktable in the same manner as it was loaded. The reciprocating L/UL units remove finished product and scrap while simultaneously loading new product for machining. The unloading unit can include an air knife and vacuum head for removing debris from the work surface as it moves over the vacuum table. Scrap and finished product are then dropped in different areas by the release of vacuum clamping pressure in selected cells.

A software program ties together the vacuum bed, accessories, and the load/unload system. This special software greatly increases programming efficiency as well as reduces the likelihood of system error by using system and program analysis to find and correct programmer error. The software also encodes the vacuum bed setup and operation at the same time the machining routine is being generated. A small controller and software act as the mind of the system, holding in memory several machining and clamping programs, synchronizing all system functions, while performing continuous diagnostics.

DETAILED DESCRIPTION

Figures 1, 2:
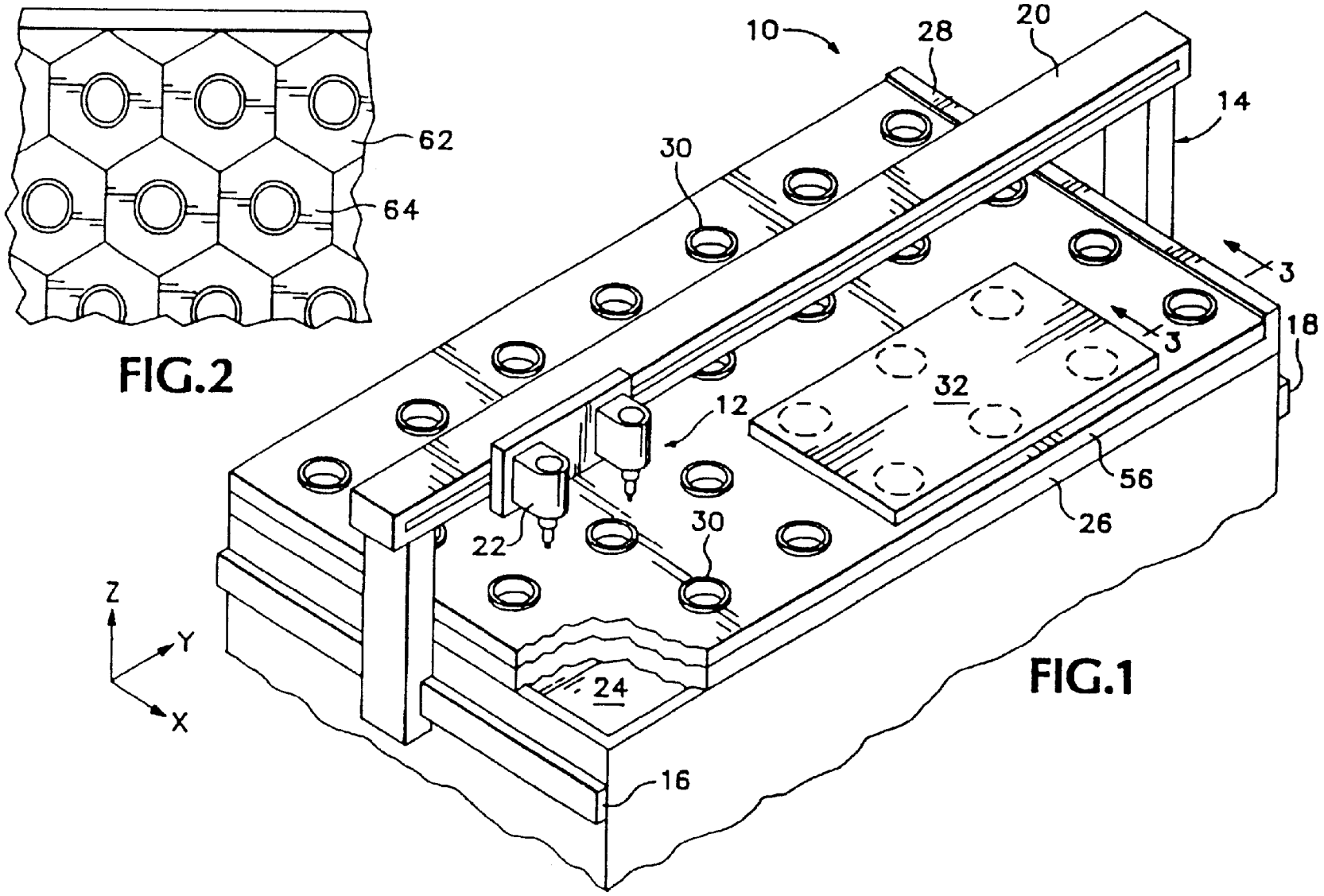
FIG. 1 is a perspective view of an exemplary machining worktable having vacuum pods arranged in a rectangular array.
FIG. 2 is a top plan view of an alternate arrangement of the vacuum pods disposed in an off-set or hexagonal array about the worktable shown in FIG. 1.

FIG. 1 shows a perspective view of an exemplary vacuum machining table 10 using the vacuum pod workpiece chucking system constructed in accordance with the present invention. Table 10 includes a tool assembly 12 which is moveable along frame 14, as by rails 16,18,20, in order to be positioned anywhere along the worktable in the X-Y plane. Tool assembly 12 includes one or more cutting tools, such as drill 22 which permit vertical displacement of the cutting tools along the Z-axis relative to the machining table 10. It will be noted that conventional machining table systems include a common vacuum chamber 24 which extends across the machine table surface to enable prior art vacuum clamping as discussed in the background of the invention.

Turning now to the aspects of the invention, table 10 is provided with a mounting board 26 which is placed about and sealed along the periphery of the common vacuum chamber thereby forming a fully enclosed vacuum source. Defined along one edge of the mounting board, as along edge 28, is a lip containing valving means which selectively transmit vacuum and pressurized air throughout the mounting board body and to the pods, such as pod housing 30, as described in more detail below.

Pod housing 30 is one of an array of pods which are coupled to the mounting board. The pods are shown in FIG. 1 in a rectangular array supporting a workpiece 32. Pods to be activated under the workpiece are shown by dashed lines. FIG. 2 shows an alternate array of pods in a hexagonal or offset arrangement. Other arrays are contemplated depending upon the size and shape of the workpiece to be machined. The location of any pod housing on the mounting board is given a unique address which is used by the CNC system to activate and deactivate the proper pods in accordance with the invention.

Figure 3:
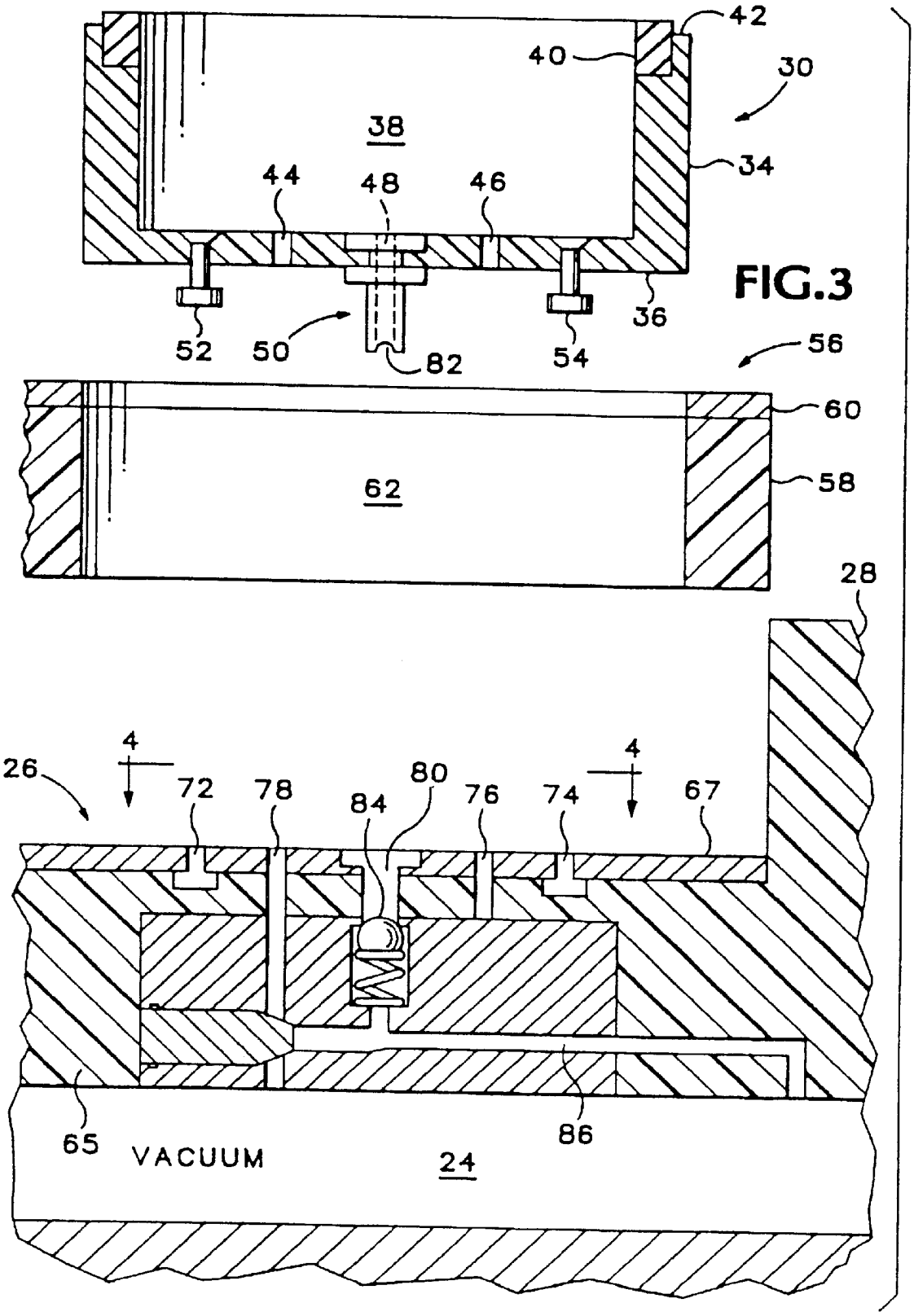
FIG. 3 is a side elevation of the vacuum pod system of FIG. 1 showing the mounting board, spoil board and vacuum pod in cross-sectional and exploded view.

FIG. 3 shows a single pod housing 30 in exploded, cross-sectioned view. Pod housing 30 includes a cylindrical side wall 34 and a circular bottom wall 36 forming a hollow interior 38. A foam gasket, such as seal 40, is positioned about the circumference of an upper surface 42 of the pod housing. The bottom wall 36 of the pod includes a plurality of apertures, such as side apertures 44,46 and central bore 48 which extends through pin 50. The bottom wall 36 also includes means for coupling the pod housing 30 to the mounting board 26, as by locking studs 52,54.

A crash-sheet element is shown at 56. Crash sheet 56, in the preferred embodiment shown in FIG. 3, is constructed of an inexpensive foam layer 58 on which is defined a conductive upper layer 60. A cavity 62 defined within the crash-sheet receives pod housing 30. As shown in FIG. 1, crash-sheet 56 can be constructed of one piece with a plurality of cavities arranged to receive the spaced array of pods coupled to the mounting board. FIG. 2 shown another embodiment wherein the slip sheet is arranged in sections, such as crash sheet sections 64,66, which are in abutting relationship to one another so that the conductive upper layers are in conductive contact with one another.

Figure 4:
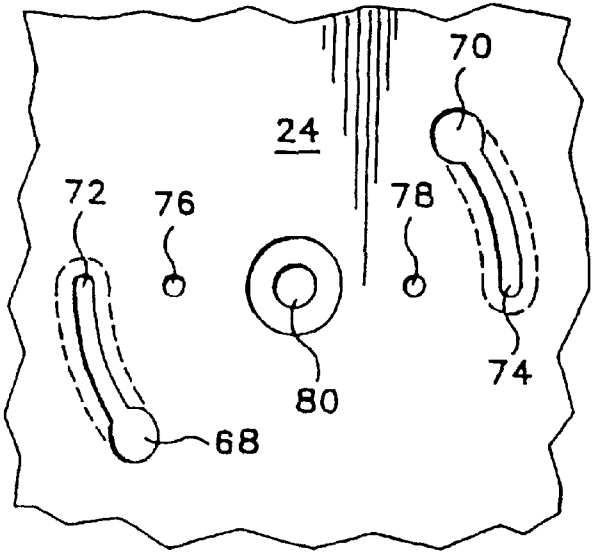
FIG. 4 is a partial top plan view of the mounting board of FIG. 3 taken along lines 4—4.

The mounting board 26 is preferably constructed of a built-up fiberboard filler 65 molded into a thermal setting resin body covered by an aluminum surface 67. Referring to FIG. 4, the upper surface of board 24 includes a plurality of locking stud receiving slots, such as through slot openings 68,70. The pod housing 30 is designed to fit into any address of the mounting board. Each address of board 24 also includes a central aperture 80 for receiving pin 50 of the pod housing 30. Simply align the locking studs 52,54 with the slot openings 68,70 and twist the pod housing so that the studs follow the radiused interior slots 72,74. The locking studs 52,54 can be spaced differently from the central bore 48 of the housing 30 and radiused slots 72,74 can be differently diametered so that the pod housing can only be coupled to the mounting board in one direction.

When mounted, the central pin 50 of the pod housing extends into the mounting board central aperture 80 and the pod housing apertures 44,46 are aligned with conduits 76,78 in the mounting board. Aperture 80 is complementary shaped to receive pin 50. Pin 50 as shown in FIG. 3 includes a radiused lower end at 82 which can contact but not engage a ball valve 84 received within the aperture 80. As will be explained further below, certain accessories such as those shown in FIGS. 12–15 include a center pin, such as long pin 100. When mounted within pod housing 30, accessory pin 100 extends through the central bore 48 of pod housing pin 50 to depress the ball valve 84, thereby transferring a vacuum from chamber 24 through conduit 86 up through the accessory.

Figure 5:
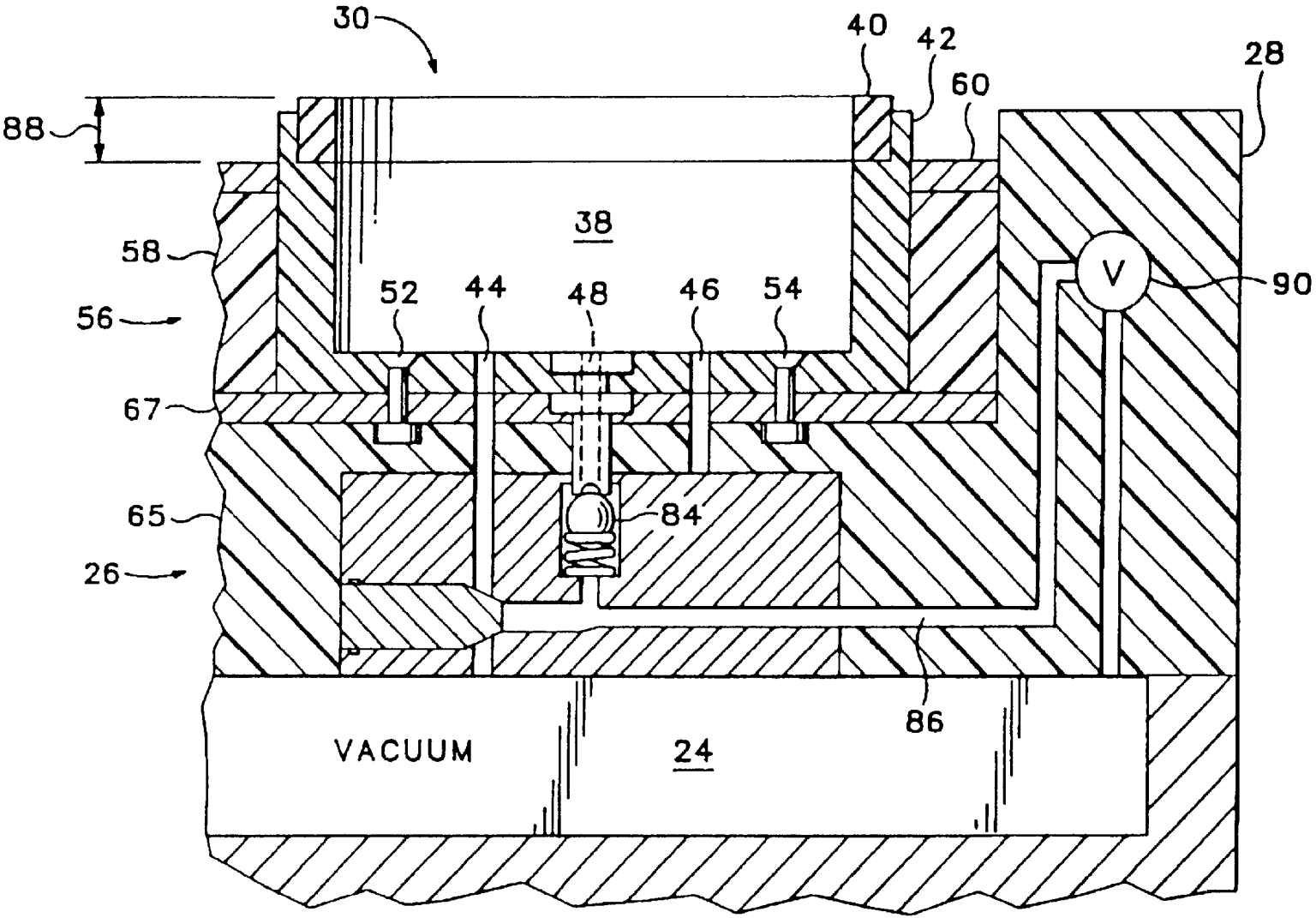
FIG. 5 is a side elevation cross-sectional view of the mounting board of the worktable of FIG. 1 shown along lines 4—4 and showing one embodiment of the vacuum pod system.
Figure 8:
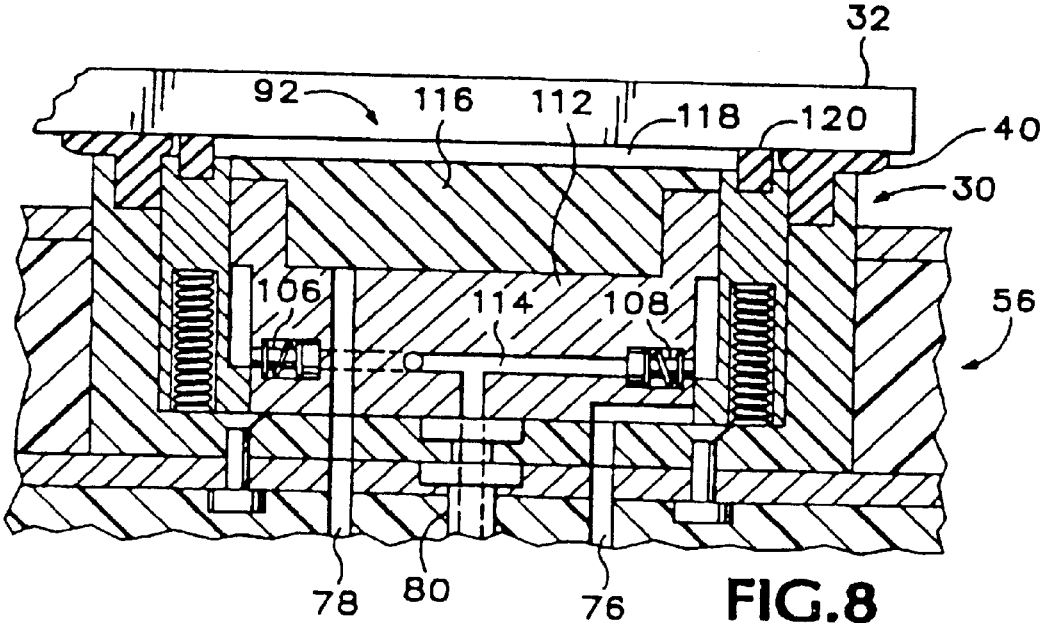

FIG. 5 shows the assembled embodiment of the invention showing vacuum pod housing 30, crash-sheet 56 and mounting board 26. Preferably, the conductive upper layer 60 of the crash sheet is positioned below the upper surface 42 of the housing side wall. The vertical distance of separation forms a minimum safety zone 88 between the supported workpiece (as shown in FIG. 8) and the crash sheet conductive upper layer 60. This is the area that the machining tool can penetrate through the workpiece and not make contact with the crash-sheet, thereby causing an automatic shut down of the system.

The preferred method of automatically shutting down the machining routine is as follows. The conductive layer 60 is charged using low voltage DC current. In the preferred embodiment, this is accomplished by applying voltage directly. When a metal tool, such as tool 22, impacts the conductive sheet, a short circuit is completed between layer 60 and tool 22 thus stopping the machining process. It would also be possible to charge the outer surface of the vacuum pod housing 30 or accessories to cause an automatic shutdown of the machining process. Note that the workpiece, if itself is conductive, would need to be electrically isolated from the conductive sheet.

In an alternate embodiment, the mounting board itself is charged. The crash sheet would have a conductive foil liner in conductive contact with the mounting board. It should be appreciate that the conductive layer 60 can be situated within the crash sheet at any level (e.g. embedded within the foam layer 58). Still another method includes both a conductive sheet 60 and a webbing of wire mesh within the foam layer. The wire mesh sheet is grounded through an automatic shut down switch of the CNC main controller. When a tool has been misprogrammed and drops below safety zone 88, the tool penetrates the conductive layer 60 and then the wire mesh thus grounding the completed circuit.

FIG. 5 also shows an alternate embodiment of the mounting board which includes a valve 90 which can be CNC activated to supply vacuum through conduit 86 to the hollow interior of the pod housing shown at 38. The preferred valve would be a solenoid type which unseats from the conduit mouth when activated by a CNC controller.

Figure 6:
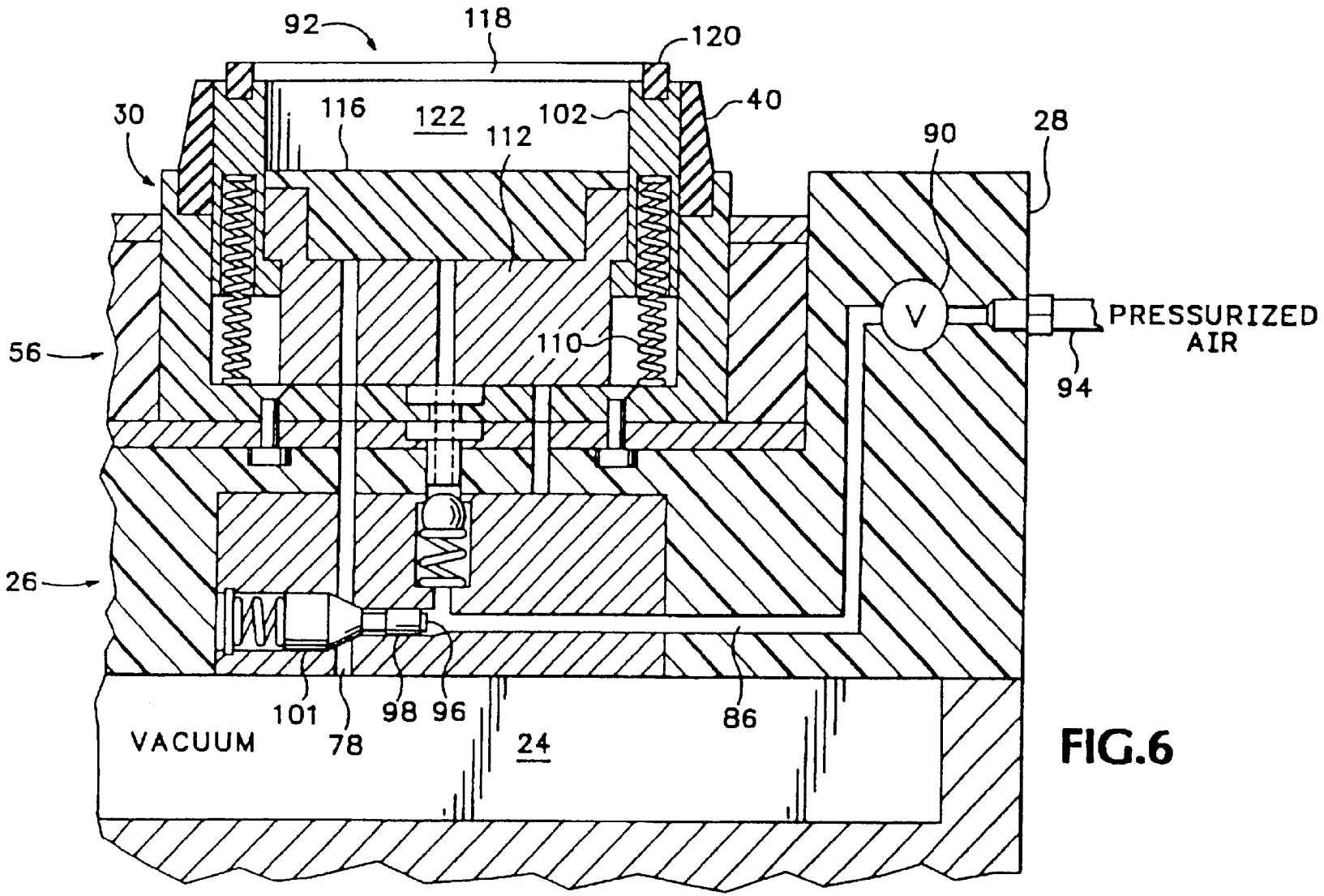
FIG. 6 is a side elevation cross-sectional view of the mounting board of the worktable of FIG. 1 shown along lines 4—4 and showing another embodiment of the vacuum pod system.

FIG. 6 shows yet another embodiment of the mounting board 26. FIG. 6 also shows a floating ring type accessory at 92 received within housing 30. Conduit 86, which in the embodiment shown in FIG. 5 leads to vacuum chamber 24, instead leads to a pressurized air source 94. When valve 90 is activated (either by automatic CN control or manually), pressurized air enters conduit 86 and bears against valve stem 96 and sliding seal 98. Stop 101 is normally biased against conduit 86 thus preventing vacuum from moving up conduit 76 to the accessory 92. Under pressure, stop 101 is pushed away from sealing contact with conduit 86, thus opening conduit 76 to vacuum.

Floating Ring Accessory

FIGS. 7–10 show the operation of the floating ring accessory 92. Accessory 92 includes an annular ring body 102 which is biased upward, such as by spring 110. Ring body 102 has a flange projection 104 defined on a lower end thereof which bears against a stop, such as retaining pins 106,108, to prevent upward movement of the ring body 102. The retaining pins, in the embodiment shown in FIGS. 7–10, are biased in a retracted position. To extend the retaining pins 106,108 into retaining contact with flange 104, pressurized air is sent through the mounting board central aperture 80 to force the retaining pins outward.

The floating ring accessory further includes an interior body 112 through which conduits, such as conduits 78,76 and 114, are defined for the passage of vacuum and pressurized air as per the invention. Conduit 76 is coupled to a vacuum source to provide vacuum up through the interior body 112 to filter body, such as filter 116 and filter layer 118. Filter layer 118 is mounted between a ring gasket 120 to prevent contamination of the ring interior 122 with dust from the machining process.

Figure 7:
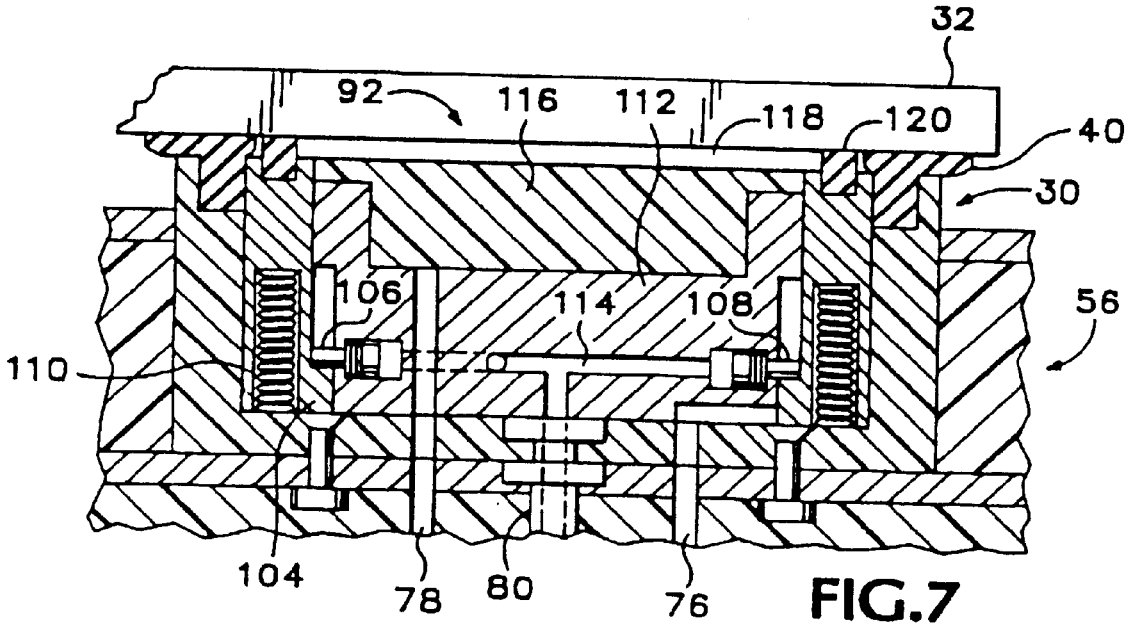
FIGS. 7–10 show in side elevation cross-sectional view the sequential operation of the floating ring accessory when placed in the vacuum pod system of FIG. 3.
Figure 9:
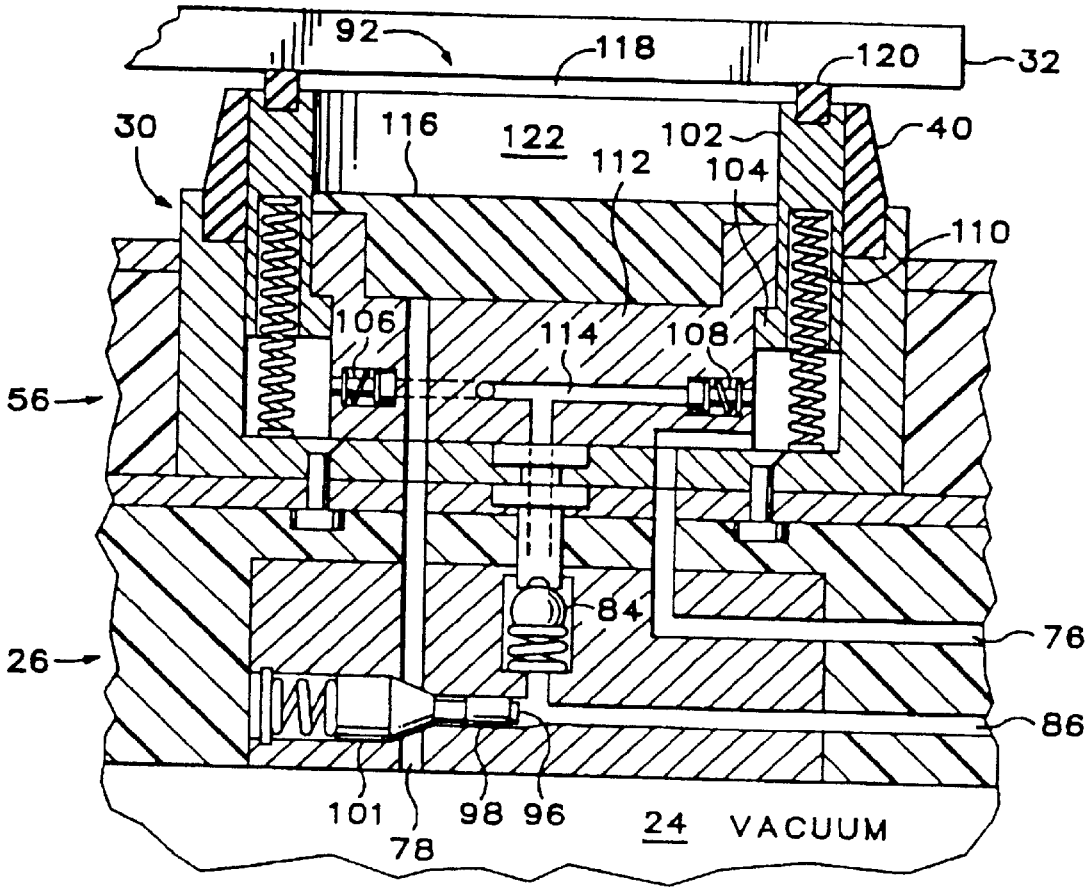

FIG. 7 shows the deactivated or lowered position of the floating ring 92. To raise the floating ring to its active position, the pressurized air against pins 106,108 is momentarily removed. The retaining pins 106,108 are then biased away from flange 106 as shown in FIG. 8 to allow the ring to move upward. The bias on the annular ring body 102 of the floating ring assembly by spring 110 causes the body to move upward to a maximum raised position as shown in FIG. 9.

Figure 10:
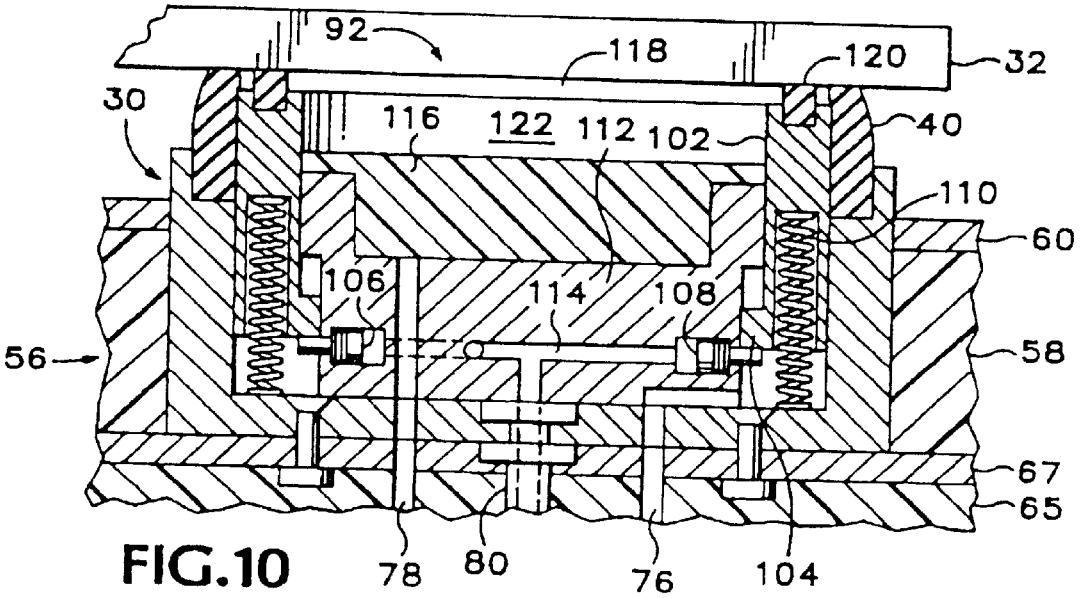

FIG. 10 shows a workpiece 32 placed on the raised ring to bear and seal against ring gasket 120 for an efficient transference of vacuum clamping of the workpiece. The outer gasket 40 of the pod housing is preferably attached the outer side wall of the annular ring body 102 and deforms when the ring is in partially or fully positions as shown in FIGS. 7–9. As shown in FIG. 10, the bottom surface of flange 108 is seated atop retaining pins 106,108 to define a minimum raised position. FIG. 9 shows the floating ring assembly in a maximum raised position. When a plurality of pod assemblies engage a workpiece with an irregular surface, each of the engaging pods can raise to a different height in order to engage the uneven surface between the maximum height shown in FIG. 9 and the minimum raised height shown in FIG. 10. To retract the ring, the retaining pins are momentarily retracted using the means described above and vacuum is applied through conduit 78 below the floating ring body 102 to draw it downward. The retaining pins 106,108 are then extended, resulting in the ring position shown in FIG. 7. It is understood that pressurized air could be used to retract pins 106,108 if biased in an extended position given an alternate path of conduit 114.

Fixed Stop Accessory

Figure 11:
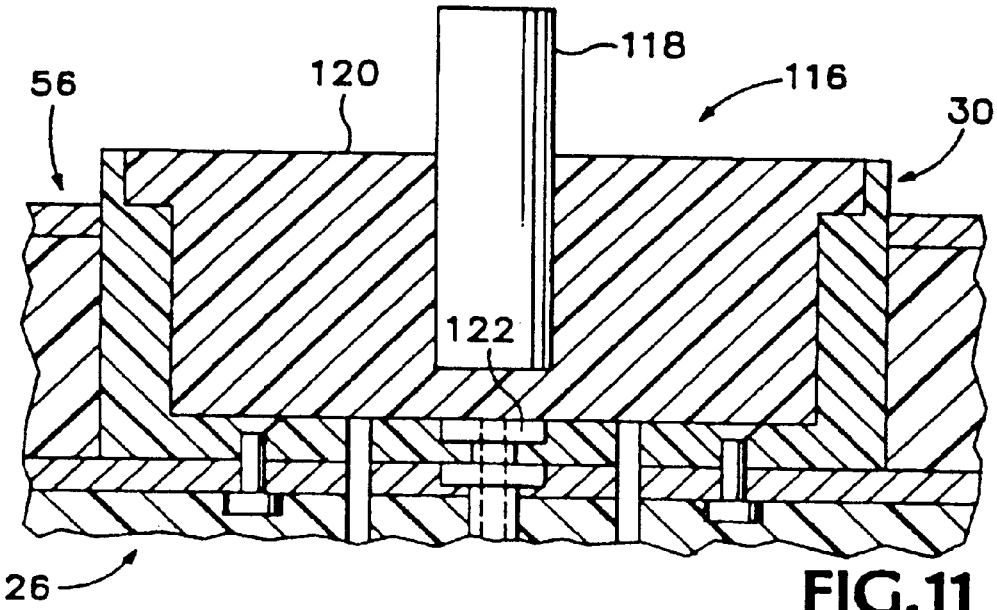
FIG. 11 is a side elevation cross-sectional view of a fixed stop accessory constructed according to the present invention.

FIG. 11 shows the fixed stop accessory at 116. In the preferred embodiment, the fixed stop includes a rod 118 extending vertically from an accessory housing 120. Housing 120 includes a bottom flange projection which fits within a depression 122 on the bottom wall 36 of the pod housing 30. Alternately, the housing can have pins (not shown) which extend into the conduits 78,76 since the fixed stop accessory does not operate under air pressure or vacuum and thus does not need the conduits to work. Rod 118 is designed to protrude upward to a height which is greater than the raised floating ring position shown in FIG. 10. Thus, a workpiece, such as a sheet of plywood will be held at a level below the fixed stop so that the edge of the plywood workpiece will abut the side walls of the rod to prevent the workpiece from moving further.

Pop-up Stop

Figure 12:
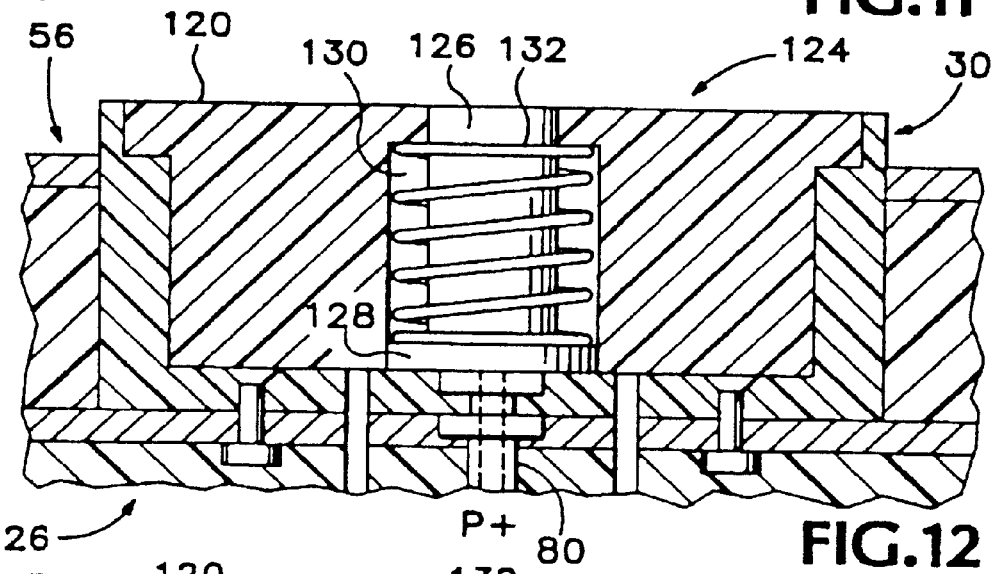
FIG. 12 is a side elevation cross-sectional view of a pop-up stop accessory constructed according to the present invention.

FIG. 12 shows the pop-up stop accessory at 124. In the preferred embodiment, the pop-up stop accessory includes a rod 126 located within a cavity 130 defined within the accessory housing 120. The rod includes a sliding seal 128 at a lower end thereof which seals against the inner wall of the cavity 130. A spring 132 biases the rod downward such that in the inactive position, the rod 126 is level with the top portion of the accessory and pod housing. The pop-up stop accessory includes a central pin which extends through the mounting board central aperture 80 to engage the ball valve 84 (as shown best in FIG. 10). Thus engaged, valve 84 can admit pressurized air up through aperture 80 and against seal 128 to force the rod 126 upward to a raised position.

In the manual embodiment of the invention, spring 132 biases the tod 126 upward. Aperture 80 is selectively coupled with a vacuum source such as common source 24. Parts to be machined are placed against a grouping of stops and when the vacuum pump is turned on, the negative pressure pulls the stop into the universal housing 120 and away from the path of the machining tool. In an alternate embodiment, the stop position can be sensed by a position sensing switch which ensures that all stops are in their lowered position before the machine tool can be allowed to start its machining operation.

Pop-up Transfer Pin

Figure 13:
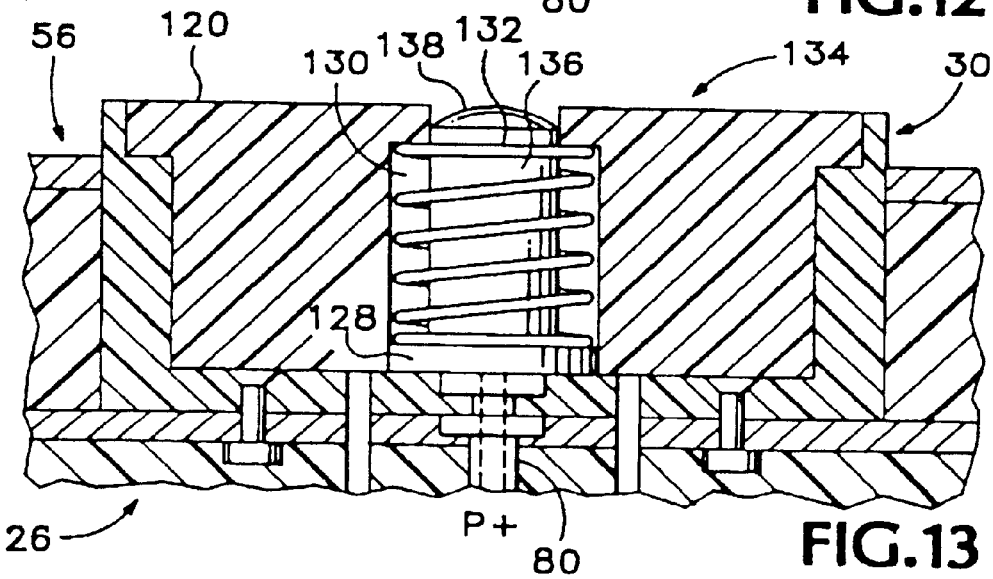
FIG. 13 is a side elevation cross-sectional view of a pop-up transfer pin accessory constructed according to the present invention.

The pop-up transfer pin, shown in FIG. 13 at 134 works on the same principal as the pop-up stop 124 shown in FIG. 12. However, the pin body 136 has an arcuately curved top surface 138. When raised to its active position, the pop-up transfer pin allows material to be easily moved across its top surface 138. For example, a group of transfer pins may be raised above the level of the retracted floating ring accessories and the workpiece slid into place against a group of pop-up or fixed stops. As soon as the workpiece is in place, the floating rings are raised to engage the workpiece in the sequence shown by FIGS. 7–10 and the transfer pins are retracted and out of the way of the machining tool.

Horizontal Clamp

Figure 14:
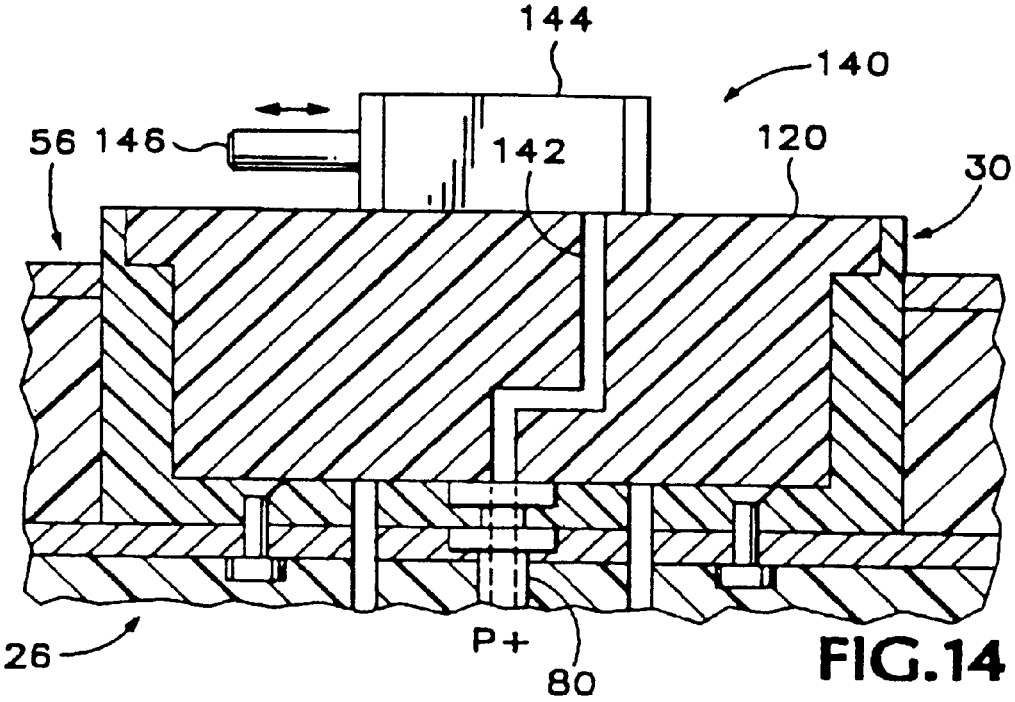
FIG. 14 is a side elevation cross-sectional view of a lateral clamp accessory constructed according to the present invention.

FIG. 14 generally shows at 140 a horizontal clamp accessory. The clamp 140 comprises an accessory body 120 which is mounted to the pod housing 30 as the pop-up stop 124 and transfer pin 134 accessories described above. A long central pin extends into the mounting board central aperture and engages the ball valve 84 to admit pressurized air (as delivered, for instance, through the mounting board of FIG. 6 above) therethrough. An air channel 142 is defined within the accessory body 120 and couples the pressurized air source from conduit 80 to a clamp housing 144 positioned on the accessory body. The housing 144 includes a horizontally displaceable member 146 which is biased inward by a spring (not shown). Pressurized air against a back face of the member 146 pushes it outward against an adjacent workpiece. It is envisioned that the horizontally displaceable member 146 can be used to accurately position a workpiece in the X-Y plane and then retracted (as by connecting conduit 80 to a vacuum source) when the machining operation is started.

Vertical Clamp

Figure 15:
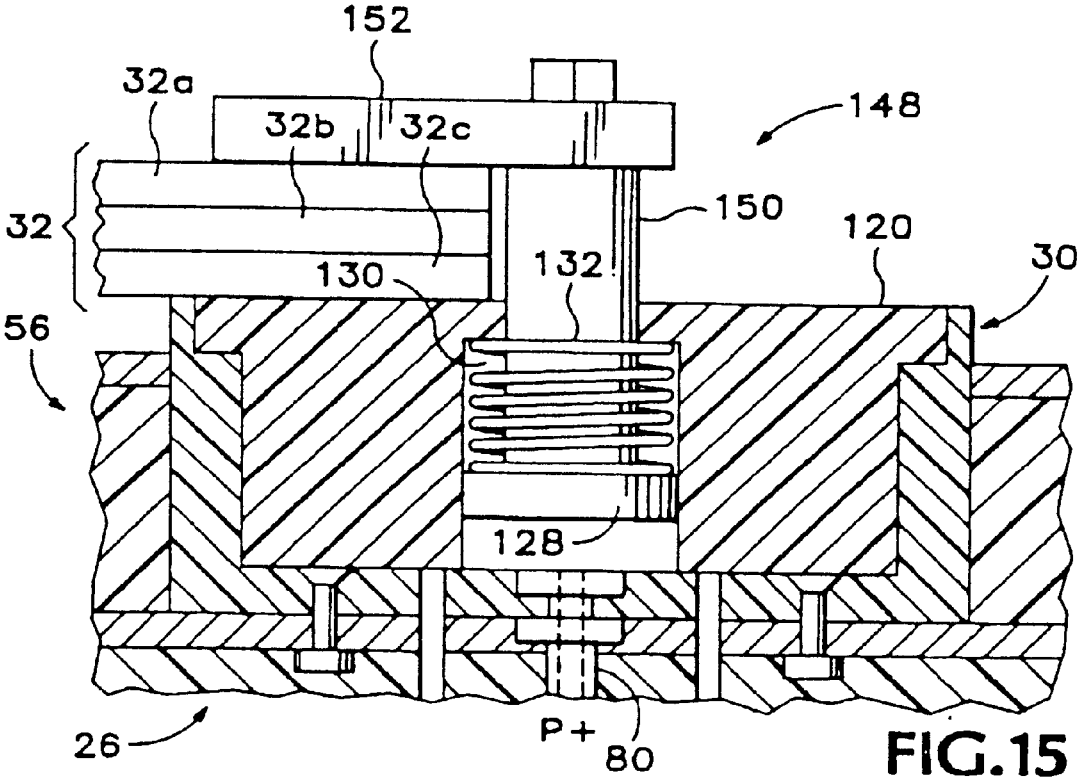
FIG. 15 is a side elevation cross-sectional view of a vertical stack clamp accessory constructed according to the present invention.

FIG. 15 generally shows at 148 a vertical stack clamp accessory employed within the pod housing 30. These are used most commonly where stacks of material need to be held in place where vacuum clamping only works on the lowest piece. Clamp 148 includes a vertical stem 150 which acts as a positioning stop when a workpiece is pushed up against it. Stem 150 includes a sliding seal 152 In the preferred embodiment, the pop-up stop accessory includes a stem 150 extending from within a cavity 130 defined within the accessory housing 120. The stem includes a sliding seal 128 at a lower end thereof which seals against the inner wall of the cavity 130. A spring 132 biases the stem downward such that a horizontal clamping arm 152 located adjacent the top end of stem 150 clamps downward against a stack of workpieces (shown generally as 32*a*,32*b*,32*c*).

In an automated embodiment, spring 130 is inverted and bears upward against seal 128. Pressurized air is routed to drive downward against the top of seal 128 to force the stem 150 and clamping arm 152 downward. This method is preferred since more clamping force can be exerted on stacked workpieces 32*a–c* using pressurized air than a mechanical bias such as spring 136.

Position Sensor Accessory

Figure 16:
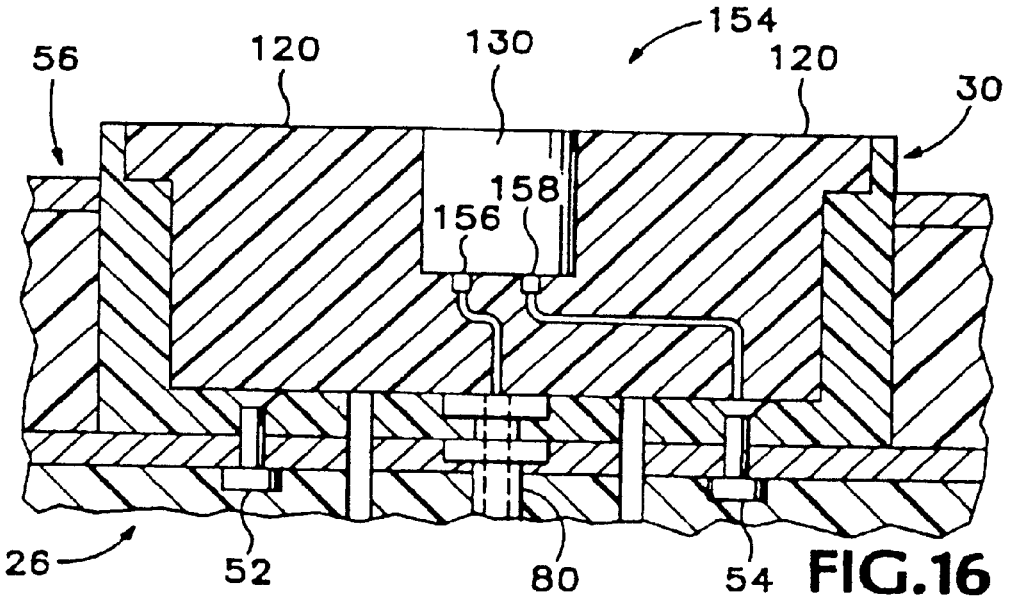
FIG. 16 is a side elevation cross-sectional view of a position sensor accessory constructed according to the present invention.

FIG. 16 shows an embodiment of a position sensor accessory at 154 within a pod housing. The accessory can be a limit switch or other sensing device needed by the user. For example, the accessory can have a light source 156 which casts light upward through the open housing body cavity 130. A workpiece located directly above the light source will reflect the light downward to be detected by a photocell detector 158. Detection of light by the photocell can tell one if the workpiece is indeed positioned over the pod housing address for further CN control. In one embodiment, air duct such as conduit 80 and 80 can be formed of a conductive material so that the conduit can carry both air (or vacuum) and electrical energy to power the sensor.

Powered Pop-up Transfer Bearing

Figure 17:
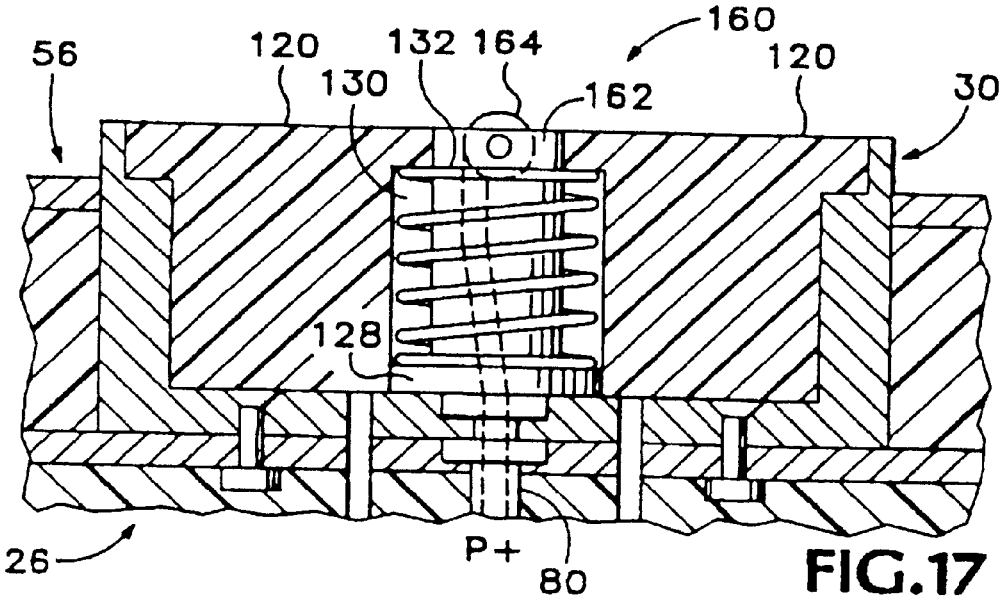
FIG. 17 is a side elevation cross-sectional view of a powered transfer bearing accessory constructed according to the present invention.

FIG. 17 shows a powered pop-up transfer bearing accessory at 160 constructed according to the present invention. The powered transfer bearing 160 operates similar to the pop-up transfer pin 134 described above. The pop-up stop accessory includes a vertically positionable rod 162 located within a cavity 130 defined within the accessory housing 120. The rod includes a sliding seal 128 at a lower end thereof which seals against the inner wall of the cavity 130. A spring 132 biases the rod downward such that in the inactive position, the rod 162 is substantially level with the top portion of the accessory and pod housing.

Figure 18:
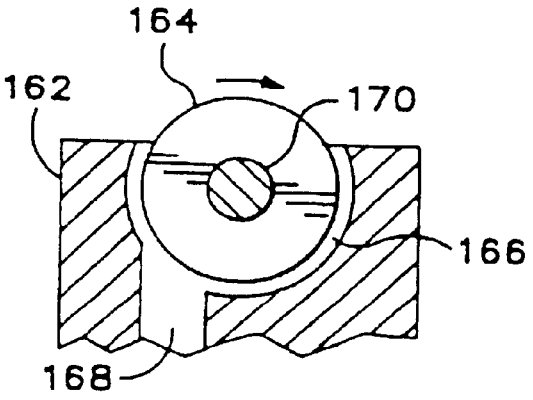
FIG. 18 is side-elevation cross-sectional view of the accessory of FIG. 17 showing the powered feed roller embodiment of the invention in greater detail.

A transfer bearing, such as bearing 164 is mounted within a bearing housing 166 at the top portion of the rod 162. The bearing housing is slightly larger than the bearing so as to define a space about the surface of the bearing through which air can pass. The housing 166 is coupled via conduit 168 to a source of pressurized air. In the preferred embodiment, the conduit 168 is coupled to the mounting board central aperture 80 and passes through rod 162 and seal 128. FIG. 18 shows the conduit off center from bearing 164 so that a majority of air drives the bearing in the direction shown by the arrow with the remainder of pressurized air seeping through space between the bearing and housing 166 on the opposite side. Thus, the bearing is kept pressurized and free of dust or other waste from the machining process.

In yet another embodiment, the powered bearing can rotate on an axle 170. Either the bearing or the axle can have a vaned surface (not shown) such that air passing over the surface will drive the bearing in only one direction. As the accessory housing 120 can be rotated within the pod housing cavity 38, the direction of rotation of the transfer bearing can be manually selected depending upon the position the accessory is placed within the pod housing. Additionally, a drive belt (not shown) can be linked between at least two of the powered bearings 164 to enable a workpiece to be more easily moved to a desired location for machining.

Pop-up Transfer Bearing

Figure 19:
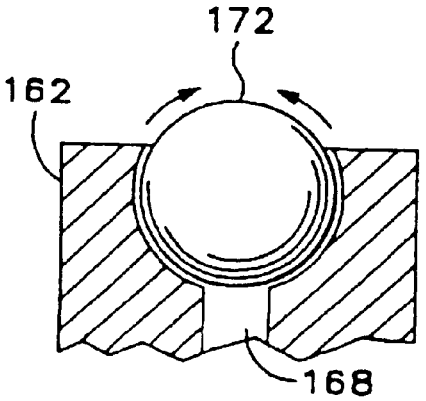
FIG. 19 is a side-elevation cross-sectional view of the accessory of FIG. 17 showing a pop-up transfer bearing embodiment of the invention in greater detail.
Figure 22:
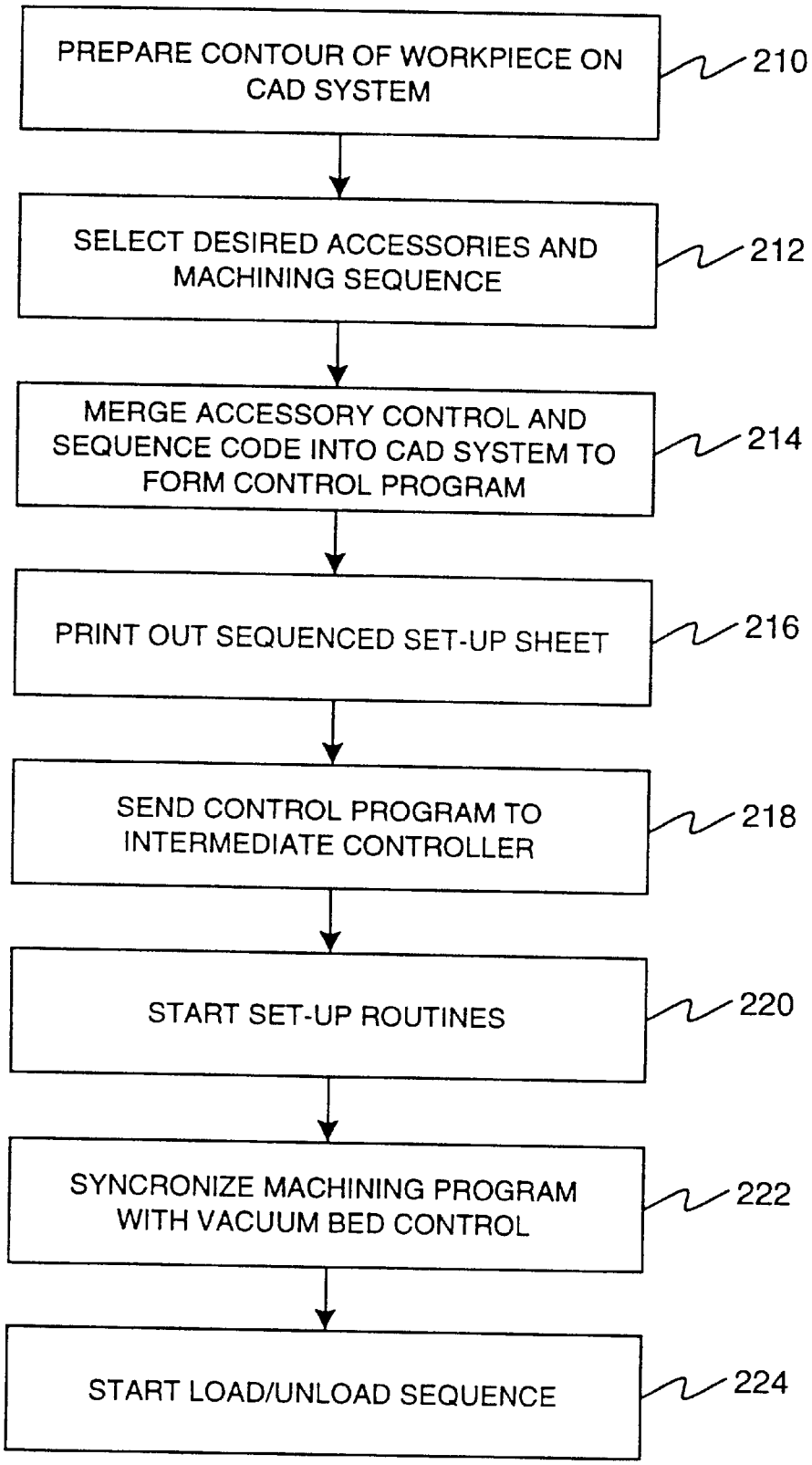
FIG. 22 is a flow chart showing the steps of operation of the vacuum bed system software control according to the invention.

FIG. 19 shows a non-powered transfer bearing at 172. The operation of the non-powered transfer bearing is similar to the power bearing accessory 160 described above except that pressurized air from the conduit 168 is substantially central to the bearing 172. In operation, the pressurized air leaks around the entire surface of the bearing as shown by the arrows to keep the bearing clean of debris.

Cap Accessory

Figure 20:
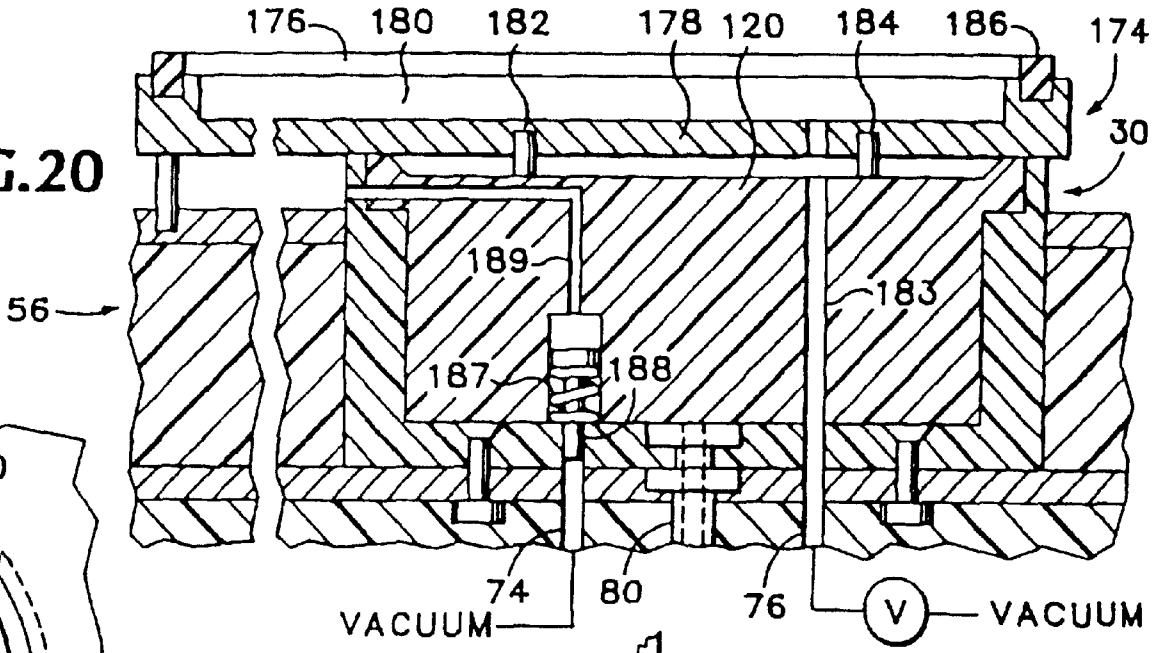
FIG. 20 is a side elevation cross-sectional view of a cap accessory constructed according to the present invention.

FIG. 20 shows the cap and cap pins accessory at 174. The cap accessory 174 is useful when a workpiece to be machined is too small or irregular or has an extremity that cannot be held by the standard floating ring accessory 102. The cap is comprised of spaced top and bottom walls 176,178 which are attached, as by gluing, along their edge walls to form an open cavity 180 therebetween. Wall 178 can also be mounted on the accessory housing 120 as by pins 182, 184. Top wall 176 can be generally a foam layer which prevents dust from falling into cavity 180. The lower plate 178 is molded fiber chips and has somewhat of a wafer appearance with walls that enclose cells that are configured to match the addresses on the mounting board.

The accessory housing includes a conduit 183 passing up from mounting board conduit 76 to supply vacuum to cavity 180. A pin 188 is biased upward by spring 187 to be in a retracted position. When accessory 174 is inserted within the pod housing 30 and the pin 188 positioned over the conduit 78 leading to vacuum, vacuum pressure pulls the pin downward into the conduit 78, thus locking the accessory in place within the pod housing and preventing the accessory from rotating. A internal conduit 189 defined within the accessory housing allows ambient pressure to enter to the backside of the pin which is slidingly sealed within an internal cavity.

Wafer Vacuum Cup

Figure 21:
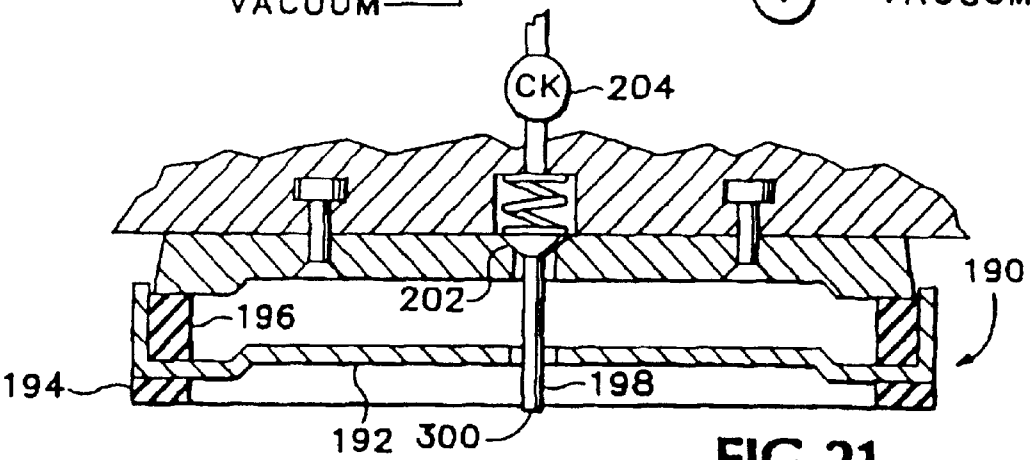
FIG. 21 is a side elevation cross-sectional view of a wafer accessory constructed according to the present invention.

FIG. 21 shows the wafer accessory at 190. The wafer includes a vacuum cup 192 which has upper and lower gaskets 194,196 respectively fixed along a periphery of the cup 192 to form a seal with a workpiece engaging the wafer. A vertically displaceable pin 198 extends out of a central portion of cup 192 and has a top portion 200 which extends above the level of upper gasket 194. The sloped bottom portion 202 of pin 198 bears against air passage walls so that when the pin 198 is depressed, as when the wafer engages a workpiece, gaskets 194 seal against the workpiece and vacuum enters the interior of the cup through check valve 204 to thus vacuum chuck the workpiece.

The check valve 204 limits the flow of vacuum pressure through it. Thus, for instance, if a workpiece extends over or seals against only a section of the upper gasket 194 but still depresses the pin 198, vacuum pressure will quickly leak out the nonsealed portion and compromise the vacuum clamping of the workpiece from adjacent wafer accessories. The check valve of each wafer accessory in the pod housing array minimizes this leak so that the properly sealed accessories are drawn into contact with the workpiece. This method has been shown to pull a warpage out of a planar workpiece such as a sheet of plywood.

When used for loading and unloading of workpieces and scrap, the wafer assemblies can be mounted on an inverted vacuum bed movable on an articulating arm over a vacuum machining table such as that described above. In a machining table having an array of pod housings 30 fitted with a plurality of floating ring accessories 92, a machining routine is run, for example cutting a shape out of a sheet of plywood using a reciprocated saw mounted on the tool assembly 12 of the worktable 10. The floating ring accessories which are supporting the scrap remain extended and the ring accessories supporting the finished workpiece are retracted. The inverted wafer vacuum assembly is then lowered over the vacuum worktable and the wafer accessories allowed to engage the scrap and carry it off. The finished workpiece can then be carried off by another unloading wafer assembly. A high volume air knife then blows the remaining debris toward a vacuum nozzle (not shown) and the result is the cleaning of the vacuum bed in preparation for raw material to be positioned for the next run.

Computer Numeric Control (CNC) System

The CNC system allows an operator to use either a standard array of vacuum clamping pod housings and accessories (such as a rectangular array as shown in FIG. 1) or a custom configuration which meets the specific requirements of the intended equipment the system will be placed upon. From that information, the representation of the mounting board array is drawn (on an isolated layer) for CAD application which can readily be loaded into whatever brand CAD/CAM software the customer may have or choose. For illustration purposes, we will call the market ready software, "Generic Brand". At the bottom of the vacuum bed representation is a group of icons that represent the numerous accessories and support equipment. The programer is then able to draw the contour of a desired part in the normal manner for the generic brand CAD or CAD/CAM program.

The programmer calls up the representation of the vacuum bed and begins drawing the contour and machining tool operations within a range of preselected layers in step 210. An example of this would be that the vacuum bed representation has been drawn on a first layer of the CAD program. The programmer may then draw the initial outline of the desired part on a second lower layer, some pocketing that will use another tool on yet another lower layer, and a drilling sequence on the lowest fourth layer. When the drawings are complete, the CNC software is asked to group all vacuum clamping addresses that are totally contained within the contour(s) drawn, thereby selecting the addresses that will be activated during the machining process. The programmer then determines the sequence of groups to be machined by placing number icons at each contour grouping.

The programmer will select desired accessory icons in step 212 and drag and drop them at individual addresses and indicate the operational sequence icon or end of contour command. This simple method of selecting the sequence of Vacuum Bed Code (VBC) operations determines how the vacuum bed program is to be merged with the CNC machine code as it is developed by the generic brand software program.

When the drawings are complete, the generic brand CAM portion of the software sequences the machining steps in the manner prescribed by the software package being used. After the generic brand CAM program completes producing the CNC machine code, the CNC system software produced according to the present invention links with the generic brand software and develops the VBC which merges in step 214 with the CNC machine code. At this point, the new program code is written along with a VBC set-up sheet in step 216 that contains a graphical representation of how the vacuum bed is to be set-up in terms of accessories to be added as well as what vacuum address will be enabled. The setup sheet produced in step 216 will also contain how the tooling will be set-up or arranged and any other pertinent information needed for fast setup.

Once the code is developed, it is ready to be sent to the CNC machining center. This is done by either sending it via a cable linking the programming computer and the CNC controller. An intermediate controller can then intercept the mailed or loaded program and strip out the VBC from the CNC machine code in step 218. The CNC machine code is sent ont the CNC controller and two systems are loaded.

To start the machining process, the operator pushes the start button of the VBC. The first step of the machining cycle is the set-up subroutine which prepares the vacuum bed as in step 220. Prompts are required to be answered to ensure that the operator has in fact installed all accessories in their correct addresses, that all vacuum pod housings 30 are at their correct addresses, and that all tools are correctly installed in the tool assembly 12.

If the micro-switches are installed in the vacuum bed cavities, some of the pre-run check-off prompts are eliminated as the sensors will automatically register the presence of the correct vacuum clamp or accessory. Once the set-up sub-routine is complete and the questions satisfactorily answered, the set-up routine is disabled and the main program is ready to run. Depending on the level of the system, the entire set-up routine should take from a few seconds to a few minutes.

Once the vacuum bed is set up, the main machining program can be started. The operator again pushes the start button of the VBC controller which starts the vacuum pump and either enables the desired vacuum clamp assemblies or, in the case of an automated system, will start the product load sequence. This sequence is shown generally as step 222. A start signal is then sent to the CNC controller initiating the machine program that will perform the desired machining operations. The complete program will commence as prepared during the programming operation using inter-controller signals that signal the completion of each phase of the operation and indicating the next. Once started, the program may run continuously or be restarted (less the set-up routine) after each contour is finished.

It is important to note that this software will operate the vacuum bed whether of not there are vacuum clamp assemblies or accessories on the vacuum bed. Regular spoilboards that are properly prepared, slip sheets, or bleeder-boards can also be placed on the mounting board and operated with full NC control.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. An apparatus for supporting and vacuum chucking a workpiece comprising:

a mounting surface, said surface having a spaced array of apertures defined therein which are operatively connected to a vacuum source;

a plurality of fixed pods each seated over and surrounding one of said apertures, said pods having an upper surface for supporting a workpiece above the mounting surface and further having a hollow interior;

an accessory slidingly received within the hollow interior of a respective one of the pods to transmit the vacuum to the workpiece; and locking means for fixing the pods to the mounting surface.

2. The apparatus of claim 1 wherein said accessory includes a floating body having a support surface adapted to be positioned in a raised position above the upper surface of the respective one of the pods and a lowered position substantially flush with the upper surface of the respective one of the pods.

3. The apparatus of claim 2, further including a spring interposed between the pod and the accessory for continuously biasing said accessory toward the raised position.

4. The apparatus of claim 2 wherein the raised position of the support surface varies between a continuum of heights above the upper surface of the pod between a maximum and a minimum height.

5. The apparatus of claim 2 wherein the accessory includes a pin located on a lower surface of the accessory, said pin being received within a respective aperture of the mounting surface for selectively activating the vacuum source to the respective one of the pods.

6. The apparatus of claim 1 wherein said accessory has a clamping surface adapted to be vertically positioned in a continuum of positions above the upper surface of the respective one of the pods to thereby hold the workpiece tightly against the respective one of the pods.

7. The apparatus of claim 6 wherein the accessory includes a pin located on a lower surface of the accessory, said pin being received within a respective aperture of the mounting surface for selectively activating the vacuum source to the respective one of the pods.

8. The apparatus of claim 1 wherein said accessory has a clamping surface adapted to bear against a side surface of the workpiece positioned above the upper surface of the respective one of the pods, said clamping surface adapted to be horizontally positioned in a continuum of positions between an extended position and a retracted position.

9. The apparatus of claim 8 wherein the accessory includes a pin located on a lower surface of the accessory, said pin being received within a respective aperture of the mounting surface for selectively activating the vacuum source to the respective one of the pods.

10. The apparatus of claim 1 wherein said accessory has a fixed stop extending above the upper surface of the respective one of the pods.

11. The apparatus of claim 1 wherein said accessory is adapted to be positioned in a raised position above the upper surface of the respective one of the pods and in a lowered position substantially flush with the upper surface of the respective one of the pods.

12. The apparatus of claim 11, the accessory having an arcuately curved upper surface to enable a workpiece to be easily slid over the upper surface of the accessory when the accessory is in a raised position.

13. The apparatus of claim 12 wherein the accessory includes a pin located on a lower surface of the accessory, said pin being received within a respective aperture of the mounting surface for selectively activating the vacuum source to the respective one of the pods.

14. The apparatus of claim 11, the accessory having a freely rotating ball bearing embedded within an upper surface of the accessory to enable a workpiece to be easily rolled over the upper surface of the accessory in any direction when the accessory is in a raised position.

15. The apparatus of claim 14 wherein the bearing is driven by drive means in a predetermined direction to enable a workpiece to be moved in a predetermined direction when the accessory is in an a raised position.

16. The apparatus of claim 15 wherein the drive means includes a pressurized air source for supplying pressurized air to the accessory and means for shunting a substantial portion of the pressurized air over one side of the bearing surface to thereby drive the bearing in the direction of the pressurized air.

17. The apparatus of claim 1 wherein said accessory includes sensing means for determining whether a workpiece is positioned over the pod.

18. The apparatus of claim 1 wherein the locking means includes first and second pins defined on a lower surface of the plurality of pods and first and second pin receiving slots defined on the mounting surface.

19. The apparatus of claim 18 wherein the first and second pin receiving slots are radiused about each of the array of apertures.

20. The apparatus of claim 19 wherein the first radiused slot is spaced differently from the aperture than the second radiused slot and the first pin is spaced from a central portion of the bottom surface of the pods differently than the second pin to thereby allow the pods to be locked onto the aperture in only one orientation.

21. A method for loading and unloading a vacuum worktable of a type having a spaced array of apertures connected to a common vacuum source, said method comprising:

providing a plurality of a first type of pods fixed over a plurality of respective apertures, said first type of pods having a support surface adapted to be vertically moveable between a raised position and a lowered position;

providing a plurality of a second type of pods fixed over a plurality of respective apertures, said second type of pods having an upper surface adapted to be vertically moveable between a raised position and a lowered position;

raising the upper surface of the second type of pods to a raised position;

lowering the support surface of the first type of pods to a lowered position;

moving a workpiece along the upper surface of the second type of pods to a predetermined position;

raising the support surface of the first type of pods to a raised position such that the support surface is substantially flush with an underside of the workpiece;

transferring vacuum through the first type of pods to the underside of the workpiece to firmly grip the workpiece;

lowering the second type of pods to a lowered position; and machining the workpiece.

* * * * *